US008820884B2

(12) United States Patent
Toya

(10) Patent No.: US 8,820,884 B2
(45) Date of Patent: Sep. 2, 2014

(54) RECORDING DEVICE AND RECORDING DEVICE CONTROL METHOD

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 138 days.

(21) Appl. No.: 13/216,406

(22) Filed: Aug. 24, 2011

(65) Prior Publication Data

US 2012/0062680 A1 Mar. 15, 2012

(30) Foreign Application Priority Data

Sep. 14, 2010 (JP) ..... 2010-205933

(51) Int. Cl.

| | |
|---|---|
| ***B41J 2/15*** | (2006.01) |
| ***B41J 11/00*** | (2006.01) |
| ***B41J 29/38*** | (2006.01) |
| ***B41J 2/165*** | (2006.01) |
| ***B41J 15/04*** | (2006.01) |
| ***B41J 11/42*** | (2006.01) |

(52) U.S. Cl.

CPC ..... *B41J 11/425* (2013.01); *B41J 11/002* (2013.01); *B41J 29/38* (2013.01); *B41J 2/16517* (2013.01); *B41J 15/04* (2013.01)

USPC ..... 347/20

(58) Field of Classification Search

USPC ..... 347/16, 20, 33, 102

See application file for complete search history.

(56) References Cited

U.S. PATENT DOCUMENTS

| | | | | |
|---|---|---|---|---|
| 6,036,300 | A | 3/2000 | Suzuki et al. | |
| 6,183,060 | B1 * | 2/2001 | Tokuda | 347/33 |
| 6,547,361 | B1 | 4/2003 | Suzuki et al. | |
| 2003/0007023 | A1 * | 1/2003 | Barclay et al. | 347/8 |
| 2003/0035023 | A1 | 2/2003 | Suzuki et al. | |
| 2003/0085947 | A1 | 5/2003 | Suzuki et al. | |
| 2005/0179723 | A1 | 8/2005 | Suzuki et al. | |
| 2012/0062680 | A1 * | 3/2012 | Toya | 347/110 |

FOREIGN PATENT DOCUMENTS

| | | | |
|---|---|---|---|
| JP | 05-301427 | A | 11/1993 |
| JP | 2005-246908 | A | 9/2005 |
| JP | 2010-184427 | A | 8/2010 |

* cited by examiner

*Primary Examiner* — Lamson Nguyen
(74) *Attorney, Agent, or Firm* — Global IP Counselors, LLP

(57) ABSTRACT

A recording device includes a conveying part that conveys a roll paper, a support part that supports the roll paper, a recording part that ejects a liquid on the roll paper supported by the support part to record an image on the roll paper, a heating part that heats the support part to dry the liquid ejected on the roll paper, a cleaning part that cleans the recording part, and a controller that controls the conveying part to convey the roll paper while controlling the cleaning part to carry out a cleaning operation for cleaning the recording part.

6 Claims, 8 Drawing Sheets

RECORDING DEVICE AND RECORDING DEVICE CONTROL METHOD

CROSS-REFERENCE TO RELATED APPLICATIONS

This application claims priority to Japanese Patent Application No. 2010-205933 filed on Sep. 14, 2010. The entire disclosure of Japanese Patent Application No. 2010-205933 is hereby incorporated herein by reference.

BACKGROUND

1. Technical Field

The present invention relates to a recording device for recording an image on a roll paper, and to a recording device control method.

2. Related Art

A conventional recording device is provided with a conveying part for conveying a roll paper, a support part for supporting the roll paper, a recording part for recording an image by discharging a liquid on the roll paper being supported by the support part, a heating part for heating the support part to dry the liquid discharged on the roll paper, and a cleaning part for cleaning the recording part (see, Japanese Laid-Open Patent Publication No. 2005-246908).

SUMMARY

However, a drawback with the prior art is that roll paper may get wrinkled during the operation of the recording part being cleaned by the cleaning part.

An object of the present invention, which was developed on reflecting on such problems in the background technology, is to minimize wrinkling of a roll paper.

A recording device according to a first aspect of the present invention includes a conveying part, a support part, a recording part, a heating part, a cleaning part and a controller. The conveying part is configured and arranged to convey a roll paper. The support part is configured and arranged to support the roll paper. The recording part is configured and arranged to eject liquid on the roll paper to record an image on the roll paper supported by the support part. The heating part is configured and arranged to heat the support part to dry the liquid ejected onto the roll paper. The cleaning part is configured and arranged to clean the recording part. The controller is configured to control the conveying part to convey the roll paper while controlling the cleaning part to carry out a cleaning operation for cleaning the recording part.

Other features of the present invention will be apparent from the following description of this specification and the appended drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
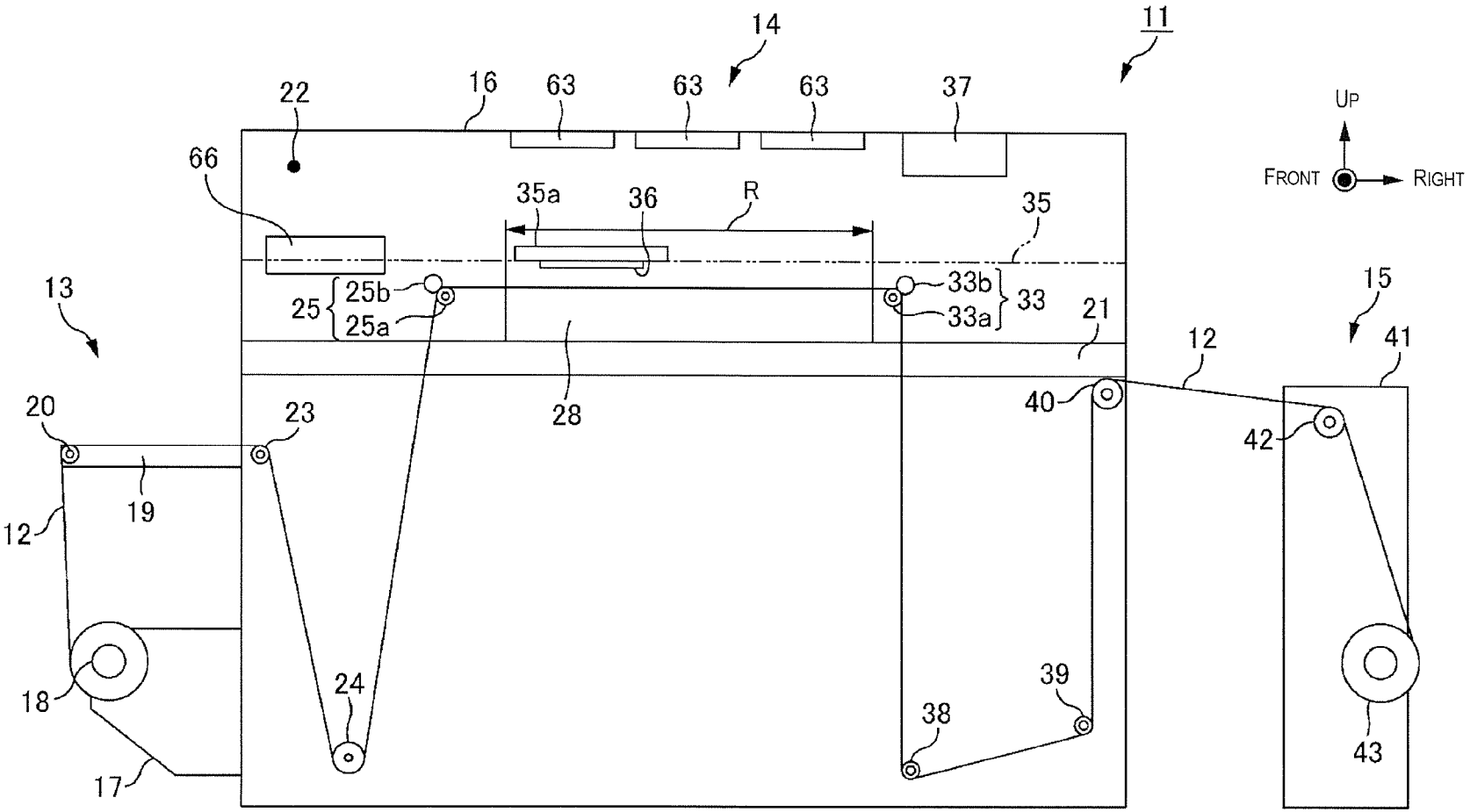
FIG. 1 is a schematic front elevation view of the printer 11 of a first embodiment.

At least the following will become apparent from the description of this specification and the appended drawings:

A recording device according to the embodiment of the present invention includes a conveying part, a support part, a recording part, a heating part, a cleaning part and a controller. The conveying part is configured and arranged to convey a roll paper. The support part is configured and arranged to support the roll paper. The recording part is configured and arranged to eject liquid on the roll paper to record an image on the roll paper supported by the support part. The heating part is configured and arranged to heat the support part to dry the liquid ejected onto the roll paper. The cleaning part is configured and arranged to clean the recording part. The controller is configured to control the conveying part to convey the roll paper while controlling the cleaning part to carry out a cleaning operation for cleaning the recording part.

Such a recording device can minimize wrinkling of a roll paper.

In the recording device of the aspect described above, the conveying part is preferably configured to convey the roll paper in a conveying direction, and the controller is preferably configured to control the conveying part to convey the roll paper a distance no more than half of a length of the support part in the conveying direction from start to end of the cleaning operation.

Such a recording device can eliminate wastage of the roll paper even when conveying the roll paper from the start to the end of the cleaning operation.

In the recording device of the aspect described above, the controller is preferably configured to select one of a plurality of types of cleaning operations differing in required operation time, and to control the cleaning part to carry out the one of the cleaning operations selected, and the controller is preferably further configured to control the conveying part to convey the roll paper no more than half of the length of the support part in the conveying direction from the start to the end of the cleaning operation regardless of a type of the cleaning operation selected.

Such a recording device can assuredly eliminate wastage of the roll paper even when conveying the roll paper from the start to the end of the cleaning operation.

In the recording device of the aspect described above, the controller is preferably configured to control the conveying part to convey the roll paper from the end of the cleaning operation to start of a recording operation wherein the recording part ejects the liquid on the roll paper to record the image, and to determine the distance over which the roll paper is conveyed by the conveying part from the end of the cleaning operation to the start of the recording operation based on a length of the roll paper conveyed by the conveying part from the start to the end of the cleaning operation.

Such a recording device can even more assuredly eliminate wastage of the roll paper even when conveying the roll paper from the start to the end of the cleaning operation.

A method for controlling a recording device according to the embodiment includes: controlling a cleaning part to perform cleaning of a recording part for ejecting a liquid on a roll paper supported by a heated support part to record an image on the roll paper; and controlling the conveying part to convey the roll paper supported by the support part while the cleaning part performs a cleaning operation for cleaning the recording part.

Such a recording device control method can minimize wrinkling of a roll paper.

First Embodiment

A first embodiment of the present invention in the form of an inkjet printer (hereafter called "printer") will be described hereinafter with reference to the accompanying drawings. In the following description, the expressions "up and down" and "left and right" refer to the directions indicated by arrows in FIG. 1. The expression "depth direction" refers to the direction perpendicular to the plane of FIG. 1.

Configuration of Printer

Figure 2:
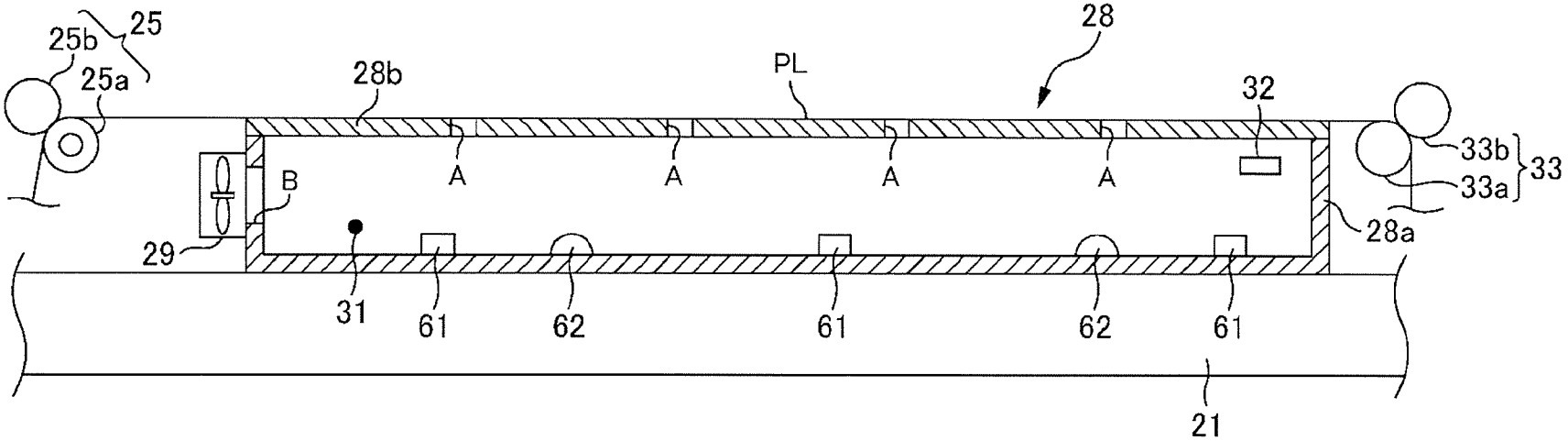
FIG. 2 is a section view of the platen 28.

FIG. 1 is a schematic front elevation view of a printer 11 of the first embodiment. FIG. 2 is a section view of a platen 28.

As shown in FIG. 1, the printer 11 comprising the recording device of the first embodiment is provided with a main body 14 for successively printing a roll paper 12 conveyed by a unreeling part 13 for supplying the roll paper 12, and a winding part 15 for taking up the roll paper 12 on which a recording operation has been performed in the main body 14. The main body 14 has a rectangular main body case 16. The unreeling part 13 is arranged to the left of the main body case 16, which is upstream in the conveying direction of the roll paper 12. The winding part 15 is arranged to the right of the main body case 16, which is downstream in the conveying direction of the roll paper 12.

The unreeling part 13 has a support plate 17 extending to the left from the lower edge of the left face of the main body case 16. A winding shaft 18 extending forward (perpendicular to the page of FIG. 1) is supported on the left edge of the support plate 17 so as to be capable of rotating relative to the support plate 17. The roll paper 12 wound into a roll beforehand is supported on the winding shaft 18 capable of rotating together with the winding shaft 18.

The unreeling part 13 also has a plate-shaped unreeling stand 19 extending horizontally to the left from the center of the left face of the main body case 16. A relay roller 20 around which is wound roll paper conveyed from the winding shaft 18 and which guides the paper to the top face of the unreeling stand 19 is disposed so as to be capable of rotating at the front edge of the unreeling stand 19. The roll paper 12 is conveyed along the top face of the unreeling stand 19 toward the right (the main body 14).

A flat base stand 21 vertically dividing the inside of the main body case 16 is disposed in a position somewhat higher than the vertical center inside the main body case 16 of the main body 14. The area inside the main body case 16 above the base stand 21 forms a printing chamber 22 for printing the roll paper 12.

A inlet port (not shown), for conveying the roll paper 12 from the top face of the unreeling stand 19 into the main body case 16, is disposed in the left wall of the main body case 16. A relay roller 23 is rotatably disposed in a location of the main body 14 opposite the inlet port.

A relay roller 24 is rotatably disposed diagonally to the right below the relay roller 23 inside the main body case 16. After entering the main body case 16, the roll paper 12 winds around the relay roller 24 from the left upper side, and is conveyed towards a position closer to the left side of the printing chamber 22.

A pair of first conveying rollers 25 for gripping the roll paper 12 to impart conveying force are disposed in a location closer to the left end of the printing chamber 22. The pair of first conveying rollers 25 comprise a first drive roller 25*a* coupled to a first conveying motor 26 (see FIG. 3) so as to be capable of transmitting power, and a first follower roller 25*b* arranged opposite the first drive roller 25*a* with the roll paper 12 disposed therebetween. A platen 28 is disposed in an area inside the printing chamber 22 to the right of the pair of first conveying rollers 25. The roll paper 12 is taken up from below to the left by the first drive roller 25*a* and conveyed horizontally to the right as the first drive roller 25*a* rotates. That is, the pair of first conveying rollers 25 are disposed in a location near the upstream side of the platen 28.

As shown in FIG. 2, the platen 28 (one example of the "support part") has a conveying direction length Lp of 914.4 mm in the first embodiment, and has a support stand 28*a*, forming substantially a box shape having a bottom and open at the top, disposed supported on the base stand 21. A rectangular carrying plate 28*b* is disposed above the support stand 28*a* so as to seal the opening in the top of the support stand 28*a*, and such that a support face PL forming its top face contacts the roll paper 12.

A multiplicity of through-holes A (of which FIG. 2 shows just four) are formed in the carrying plate 28*b* passing through the carrying plate 28*b* vertically (the thickness direction of the carrying plate 28*b*). An exhaust port B is formed in the left wall of the support stand 28*a*, and a suction fan 29 communicates through the exhaust port B as suction means. When the suction fan 29 is driven to rotate by a suction fan motor (see FIG. 3) 30, the air in the surrounding space between the support stand 28*a* and the carrying plate 28*b* is expelled out through the suction fan 29. That is, the surrounding space between the support stand 28*a* and the carrying plate 28*b* forms a negative-pressure chamber 31 where a negative pressure is generated based on the driving of the suction fan 29. A suction unit comprises, for example, the suction fan 29, the suction fan motor 30, the negative-pressure chamber 31, the through-holes A, and the like.

Generating a negative pressure in the negative-pressure chamber 31 as the suction fan 29 rotates exerts a similar negative pressure inside the through-holes A in the carrying plate 28*b* communicating with this negative-pressure chamber 31. As a result, the through-holes A in the carrying plate 28*b* function as suction holes bringing suction force to bear on the roll paper 12 conveyed onto the platen face PL of the platen 28. There is provided in the negative-pressure chamber 31*a* pressure detection sensor 32 for detecting change in the pressure of the negative-pressure chamber 31 in concert with the rotational drive of the suction fan 29.

As shown in FIG. 1, a pair of second conveying rollers 33 for gripping the roll paper 12 to impart conveying force are disposed in the area inside the printing chamber 22 to the right of the platen 28. Specifically, the pair of second conveying rollers 33 are disposed in a location near the downstream edge of the platen 28 in the conveying direction. The pair of second conveying rollers 33 comprise a second drive roller 33*a* coupled to a second conveying motor 34 so as to be capable of transmitting power (see FIG. 3), and a second follower roller 33*b* arranged opposite the second drive roller 33*a* with the roll paper 12 disposed therebetween.

After being conveyed horizontally to the right via the pair of first conveying rollers 25 onto the platen face PL of the platen 28, the roll paper 12 is taken up by the second drive roller 33*a* from above to the left. The conveying direction of the roll paper 12 is changed from horizontally to the right to vertically downward. After the second drive roller 33*a* changes the conveying direction of the roll paper 12 to vertically downward, the roll paper 12 is conveyed vertically downward through a through-hole (not shown) disposed in the base stand 21. The top face of the second drive roller 33*a* is on the same plane as the top face of the first drive roller 25*a* and the platen face PL of the platen 28. The second follower roller 33*b* is configured so as to make contact only with the edge in the widthwise direction (depth direction) of the printing face of the roll paper 12. A conveying unit (one example of the "conveying part") comprises, for example, the unreeling part 13, the winding part 15, the winding shaft 18, the relay roller 23, the relay roller 24, the pair of first conveying rollers 25, the pair of second conveying rollers 33, and the like.

A pair of guide rails 35 extending to the left and right (shown by a broken line in FIG. 1) are disposed inside the printing chamber 22 to the front and rear of the platen 28. The top faces of the guide rails 35 are higher than the platen face PL of the platen 28. A rectangular carriage 35*a* is supported on the top faces of both guide rails 35 so as to be capable of moving back and forth to the left and right along both guide rails 35.

A recording head 36 (one example of the "recording part") is supported on the bottom face of the carriage 35*a*. Many ink discharge nozzles (substantially not shown) are disposed in the depth direction on the bottom face of the recording head 36. A valve unit 37 for temporarily storing ink is disposed on the upper wall of the main body case 16 inside the printing chamber 22. The valve unit 37 is connected to the recording head 36 through an ink supply tube (not shown). The recording head 36 records an image by spraying ink from the ink discharge nozzles onto the surface of the roll paper 12 stopped above the platen 28, the ink being supplied from the valve unit 37. Specifically, the area where the recording head 36 can discharge ink to record an image is an area located along the conveying route of the roll paper 12 and above the platen 28 from the left to the right edge.

A heater unit 61 (one example of the "heating part") for heating the platen 28 is housed below the platen 28. Heat transmitted to the roll paper 12 through the platen 28 heated by the heater unit 61 promotes drying of the ink adhering to the roll paper 12. A temperature detection sensor 62 for detecting the temperature of the platen 28 is disposed on the platen 28. A controller 44 (described later) controls the heat quantity of the heater unit 61 so as to bring the platen 28 to a predetermined temperature (for example, 45° C.) based on the temperature detected by the temperature detection sensor 62.

An air-blowing fan 63 driven to rotate in concert with the rotational driving of an air-blowing fan motor 64 (see FIG. 3) is disposed in an upper portion of the main body case 16. The air-blowing fan 63 draws air from outside the printer 11, and blows this air toward the roll paper 12 supported by the platen 28 to promote drying of the ink adhering to the roll paper 12.

The roll paper 12 taken up by the second drive roller 33*a* and conveyed vertically downward is taken up from above to the left by an inverting roller 38 rotatably disposed in a location perpendicularly below the second drive roller 33*a* inside the main body case 16, then conveyed upward somewhat diagonally to the right. The roll paper 12 conveyed from the inverting roller 38 is taken up from below to the left by a relay roller 39 rotatably disposed to the right of the inverting roller 38 inside the main body case 16, then conveyed upward inside the main body case 16 so as to follow the right wall of the main body case 16. After being printed above the platen 28, the roll paper 12 is allowed to dry in an unassisted manner during the process of being conveyed through the main body case 16.

An outlet (not shown) for delivering the roll paper 12 to the winding part 15 is disposed in a location on the right wall of the main body case 16 near the base stand 21. A delivery roller 40 is rotatably disposed in a location opposite a location near the outlet inside the main body case 16. The delivery roller 40 delivers the roll paper 12 through the outlet port to the winding part 15.

The winding part 15 has a rectangular take-up frame 41. A relay roller 42 is rotatably disposed on the top edge of the take-up frame 41. The roll paper 12 delivered from the inlet port is taken up by the relay roller 42 from above to the left, and then conveyed downward diagonally to the right.

A take-up drive shaft 43 extending forward is supported diagonally to the right below the relay roller 42 in the take-up frame 41 so as to be capable of rotating relative to the take-up frame 41. The roll paper 12 conveyed diagonally below to the right from the relay roller 42 is wound onto the take-up drive shaft 43. The roll paper 12 is taken up successively as the take-up drive shaft 43 rotates.

The main body 14 has a cleaning part 66 (one example of the "cleaning part") in an upper left area inside the main body 14. The cleaning part 66 is a mechanism for cleaning the recording head 36 at a predetermined timing, such as at the start of a recording operation or a fixed time after the previous cleaning operation, to allow the recording head 36 to discharge ink in a suitable manner. The cleaning part 66 has a suction pump (not shown) as a negative pressure source for suctioning ink, and a wiper (not shown) and the like for wiping clean the discharge opening face of the recording head 36. "Cleaning the recording head 36" refers to suctioning by the suction pump or wiping by the wiper to overcome clogging of the nozzles, removing ink or debris adhering to the face where the nozzles are arranged, or the like. During cleaning of the recording head 36, the carriage 35*a* conveys the recording head 36 to the cleaning part 66.

For the cleaning operation of the cleaning part 66, there are a plurality of types of cleaning operations requiring different times. In the first embodiment, there is a cleaning operation that is completed in a short time (about 3 minutes), a cleaning operation that takes a longer time (about 10 minutes), and the like. A suitable cleaning operation is selected according to the condition of the recording head 36.

Control of Printer

Figure 3:
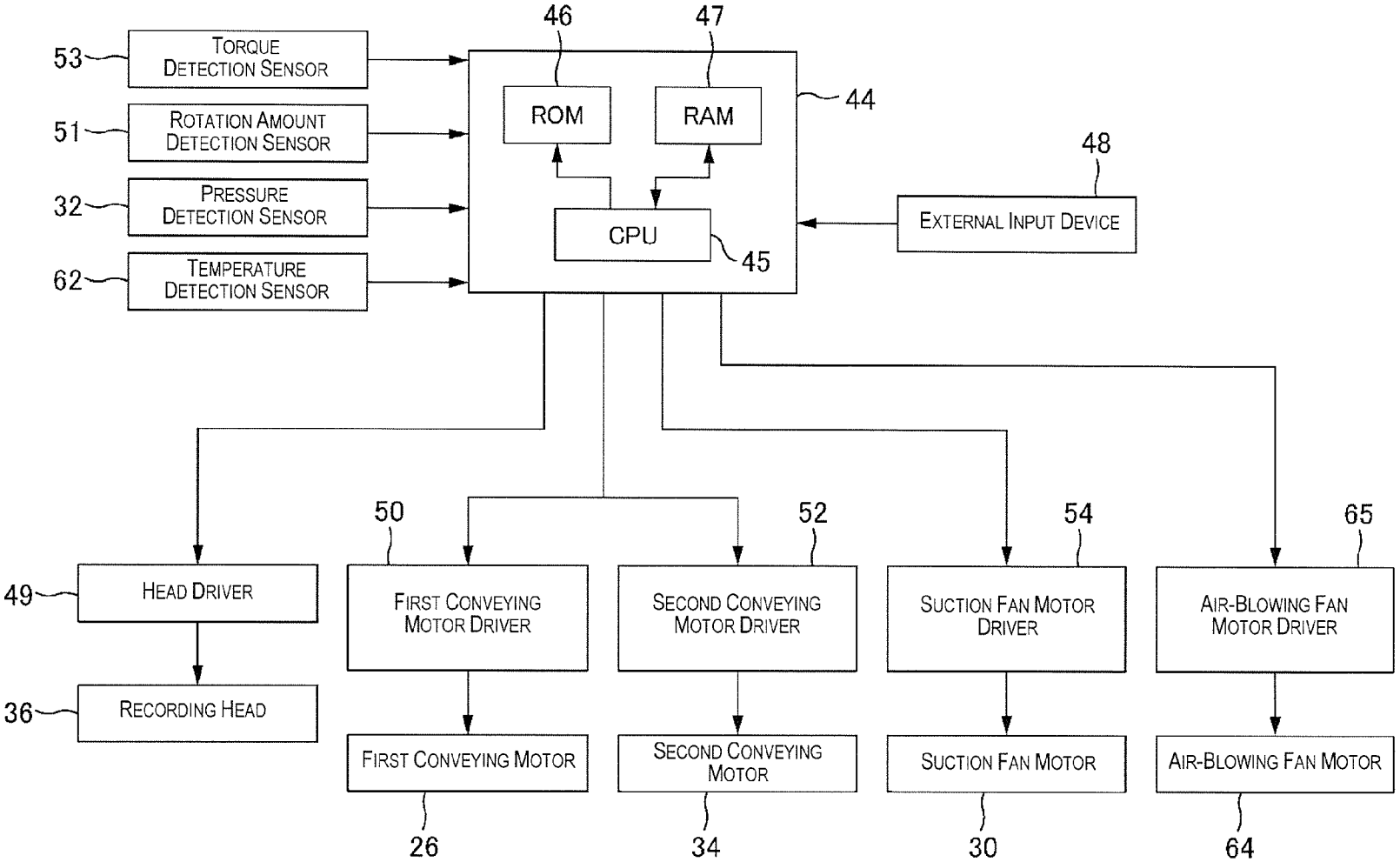
FIG. 3 is a block diagram of the control configuration of the printer 11.

Next, control of the printer 11 of the present embodiment will be described. FIG. 3 is a block diagram of the control configuration of the printer 11 in the first embodiment.

As shown in FIG. 3, a controller 44 for controlling the drive state of the overall apparatus is disposed in the printer 11. The controller 44 has a CPU 45 comprising a central processing unit, a ROM 46, and a RAM 47. The ROM 46 stores a program of processing routines regarding the recording and cleaning operations shown by the flowchart in FIG. 3, and the like. The RAM 47 temporarily stores results of computation by the CPU 45, printing data inputted by an external input device 48, and the like.

The controller 44 is connected to the recording head 36 through a head driver 49. The controller 44 reads printing data inputted by the external input device 48 from the RAM 47, and sends the read printing data to the head driver 49. The head driver 49 discharges ink droplets from the ink discharge nozzles of the recording head 36 based on the printing data received from the controller 44.

The controller 44 performs driving control of the first conveying motor 26 through a first conveying motor driver 50. The first drive roller 25*a* conveys the roll paper 12 downstream in the conveying direction in concert with the rotational drive of the first conveying motor 26 until a predetermined conveying distance has been reached based on the degree of rotation of the first conveying motor 26.

A rotation amount detection sensor 51 for detecting the degree of rotation of the first conveying motor 26 is connected to the controller 44. The controller 44 exercises feedback control of the degree of rotation of the first conveying motor 26 through the first conveying motor driver 50 based on the detection result for the degree of rotation of the first conveying motor 26 received from the rotation amount detection sensor 51.

The controller 44 performs driving control of the second conveying motor 34 through a second conveying motor driver 52. The second drive roller 33*a* is designed to impart a predetermined tension based on the torque of the second conveying motor 34 to the roll paper 12 in concert with the rotational drive of the second conveying motor 34.

A torque detection sensor 53 for detecting the torque of the second conveying motor 34 is connected to the controller 44. The controller 44 exercises feedback control of the torque of the second conveying motor 34 through the second conveying motor driver 52 based on the detection result for the torque of the second conveying motor 34 received from the torque detection sensor 53.

The controller 44 performs driving control of the heat quantity of the heater unit 61 to bring the platen 28 to a predetermined temperature (for example, 45° C.) based on the temperature detected by the temperature detection sensor 62. The platen 28 thus kept at a predetermined temperature promotes drying of the ink adhering to the roll paper 12.

The controller 44 performs driving control of the suction fan motor 30 through a suction fan motor driver 54. In concert with the rotational driving of the suction fan motor 30, the suction fan 29 evacuates the negative-pressure chamber 31 at a predetermined suction force based on the speed of rotation of the suction fan motor 30. As a result, the negative pressure inside the negative-pressure chamber 31 acts as a force suctioning the roll paper 12 to the platen face PL of the platen 28 through the through-holes A in the carrying plate 28*b*.

The controller 44 performs driving control of the air-blowing fan motor 64 through the air-blowing fan motor driver 65. In concert with the rotational driving of the air-blowing fan motor 64, the air-blowing fan 63 rotates to take in air from outside the printer 11, and blows this air toward the roll paper 12 supported by the platen 28. This promotes drying of ink adhering to the roll paper 12.

Image Frame

Next, an image frame F will be described to aid in the later description.

During the recording operation, the printer 11 alternates between a discharge process in which the recording head 36 discharges ink onto the portion of the roll paper 12 located above the platen face PL of the platen 28, and a conveying process in which the conveying unit conveys the roll paper 12 after the discharge process has ended (that is, an image has been completely formed on this portion of the roll paper). As a result, the printer 11 continuously records images on the roll paper 12. The area of an image recorded on the roll paper 12 during a discharge process carried out between a given conveying process and the next conveying process (counted as one discharge process) is called the image frame F.

When printing a printed object (for example, a seal, a label, a sticker, or the like; hereafter, printed object is called the "unit image P") that is no more than half the size of the platen 28, the printer 11 can print a plurality of printed objects together in one discharge process. In this case, one image frame F includes a plurality of unit images P.

When printing a printed object having a size greater than half the size of the platen 28, but no greater than the size of the platen 28 (for example, a poster or the like), the printer 11 can print one printed object in one discharge process. In this case, one image frame F includes one unit image P.

The printer 11, however, cannot print a printed object that is larger than the platen 28.

The distance for conveying the roll paper 12 while carrying out a cleaning operation will be described in the operation of a printer to be described later, but before this description, the conveying direction length of the image frame F will be described in detail below.

The conveying direction length Lf of the image frame F (see FIG. 4A) is no greater than the conveying direction length Lp of the platen 28 (in the first embodiment, 914.4 mm) and greater than half (Lp/2) the conveying direction length of the platen 28 (in the first embodiment, 457.2 mm). In the conveying process, the conveying unit conveys the roll paper 12 as much as the conveying direction length Lf of the image frame F, but this length Lf is no greater than the conveying direction length Lp of the platen 28 and greater than half (Lp/2) the conveying direction length of the platen 28 ($Lp \geq Lf > Lp/2$).

There shall now be given a description of why the conveying direction length Lf of the image frame F is no greater than the conveying direction length Lp of the platen 28 and greater than half (Lp/2) the conveying direction length of the platen 28.

Figure 4A:
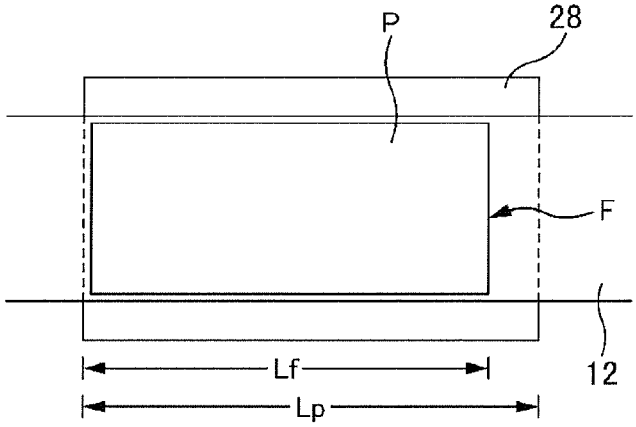
FIG. 4A is a plan view showing an image frame F when the conveying direction length of a unit image P is somewhat shorter than the conveying direction length Lp of the platen 28.

The reason why the maximum conveying direction length of the image frame F is the conveying direction length Lp of the platen 28 is that the printer 11 cannot record a unit image P that is longer than the conveying direction length Lp of the platen 28. FIG. 4A is a plan view showing an image frame F when the conveying direction length of the unit image P is somewhat shorter than the conveying direction length Lp of the platen 28. As shown in FIG. 4A, one unit image P is recorded on the roll paper 12 in one discharge process (that is, in one image frame F).

Figure 4B:
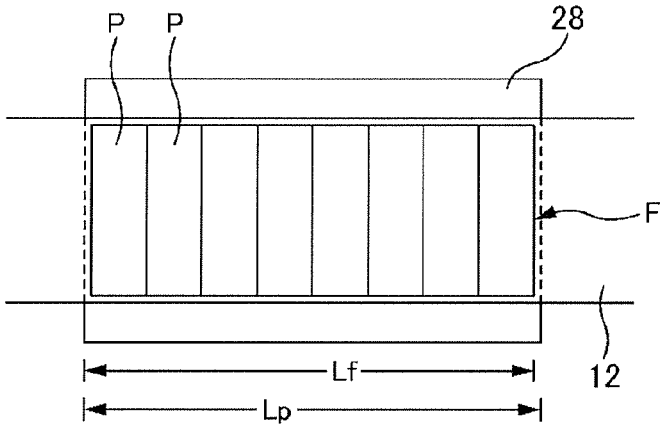
FIG. 4B is a plan view showing an image frame F when the conveying direction length of a unit image P is much shorter than the conveying direction length Lp of the platen 28.

When the unit image P is sufficiently shorter than the conveying direction length of the platen 28, on the other hand, many unit images P may be arranged in the conveying direction provided that they do not exceed the conveying direction length Lp of the platen 28, and many unit images P can be recorded in one discharge process. FIG. 4B is a plan view showing an image frame F when the conveying direction length of the unit image P is much shorter than the conveying direction length Lp of the platen 28. As shown in FIG. 4B, in one recording operation (that is, in one image frame F) a plurality of unit images P are recorded on the roll paper 12.

Figure 4C:
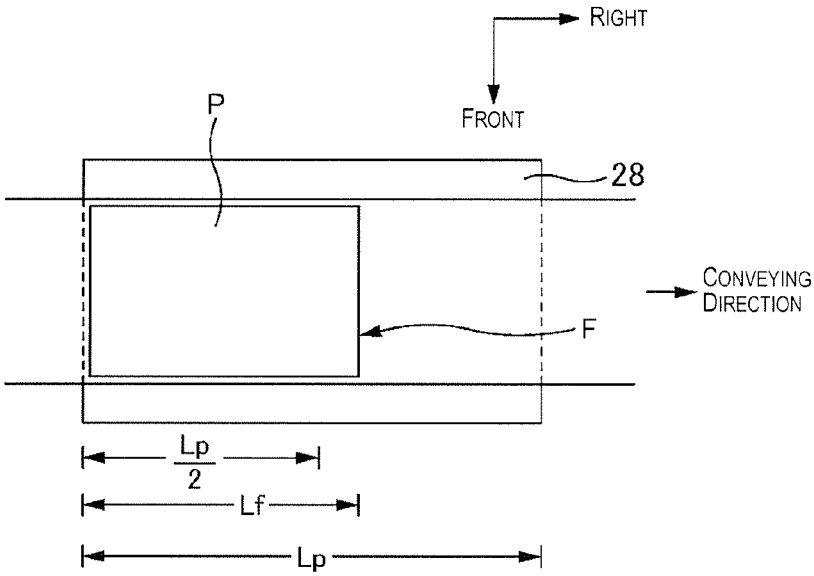
FIG. 4C is a plan view showing an image frame F when the conveying direction length of a unit image P is somewhat greater than half (Lp/2) the conveying direction length Lp of the platen 28.
Figure 4D:
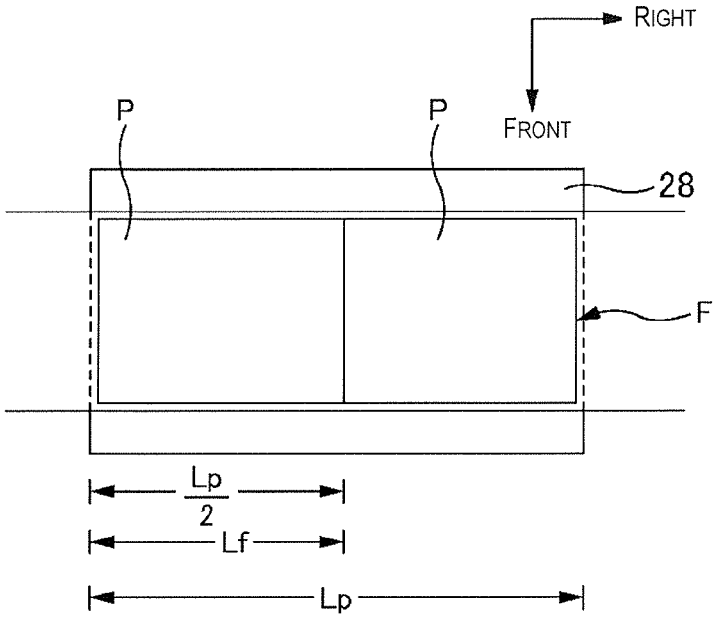
FIG. 4D is a diagram showing an image frame F when the conveying direction length of a unit image P is half (Lp/2) the conveying direction length Lp of the platen 28.

The minimum conveying direction length of the image frame F is half (Lp/2) the conveying direction length of the platen 28. This is because a conveying direction length of the unit image P that is successively shorter than Lp results in the conveying direction length of the image frame F being successively shorter. Specifically, when the conveying direction length of the unit image P is slightly greater than Lp/2, two such unit images P cannot be arranged in the conveying direction, and the conveying direction length of the image frame F is marginally greater than Lp/2. FIG. 4C is a plan view showing an image frame F when the conveying direction length of a unit image P is somewhat greater than half (Lp/2) the conveying direction length Lp of the platen 28. As shown in FIG. 4C, one unit image P is recorded on the roll paper 12 in one recording operation (that is, in one image frame F). When the conveying direction length of the unit image P is Lp/2, however, two such unit images P can be arranged in the conveying direction. Therefore, the conveying direction length of the image frame F is Lp. FIG. 4D is a plan view showing an image frame F when the conveying direction length of the unit image P is half (Lp/2) the conveying direction length of the platen 28. As shown in FIG. 4D, two unit images P are recorded on the roll paper 12 in one discharge process (that is, in one image frame F). Thus, when the conveying direction length of the unit image P is slightly greater than Lp/2, the conveying direction length of the image frame F is a minimum of half (Lp/2) the conveying direction length of the platen 28.

As described earlier, the conveying direction length of the image frame F in the printer 11 is no greater than the conveying direction length Lp of the platen 28 (in the first embodiment, 914.4 mm) and greater than half (Lp/2) of the conveying direction length of the platen 28 (in the first embodiment, 457.2 mm).

Operation of Printer

Figure 5:
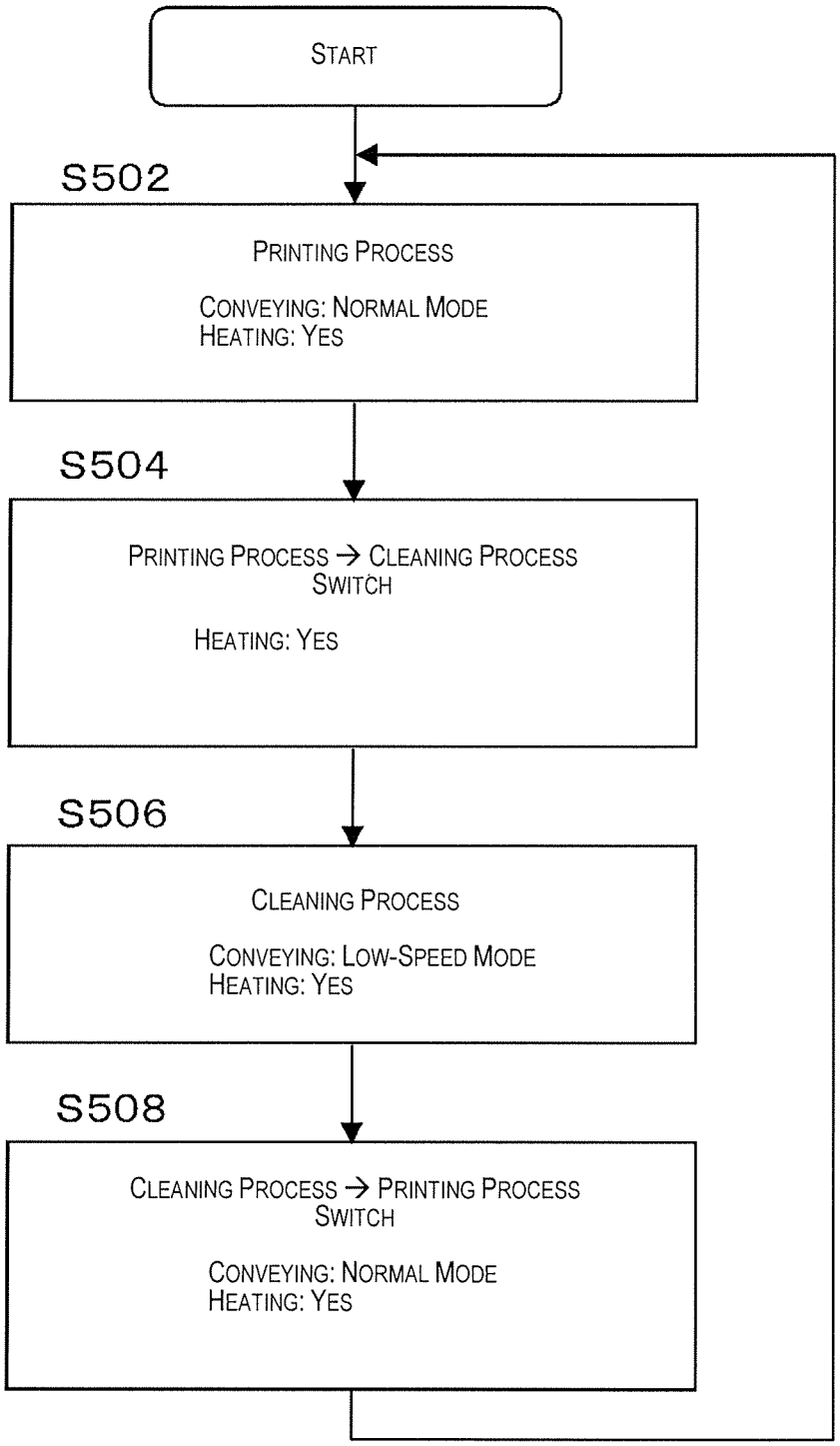
FIG. 5 is a flow diagram illustrating the operation of the printer 11.

Next, the operation of the printer 11 configured as described earlier will be described. FIG. 5 is a flow diagram illustrating the operation of the printer 11. The controller 44 reads and executes a program of processing routines regarding the operation of the printer 11 from the ROM 46 to control the recording operation and the cleaning operation in the printer 11. In the present embodiment, printing data for the recording head 36 to print on the roll paper 12 are inputted in advance from the external input device 48 to the RAM 47 before the controller 44 executes a program of routines regarding the recording operation and the cleaning operation.

As shown in FIG. 5, upon receiving a printing instruction from the external input device 48, the controller 44 carries out a recording operation (S502). When carrying out the recording operation, the controller 44 promotes drying of ink adhering to the roll paper 12 by controlling the heat quantity of the heater unit 61 based on the temperature detected by the temperature detection sensor 62 so as to bring the platen 28 to a predetermined temperature (for example, 45° C.).

When carrying out the recording operation, the controller 44 executes a discharge process in which the recording head 36 is made to discharge ink on the portion of the roll paper 12 located above the platen face PL of the platen 28 to record an image on this portion.

The controller 44 has the conveying unit execute a conveying process for conveying the roll paper 12 to eject the portion of the roll paper 12 on which an image was recorded above the platen face PL of the platen 28, and to convey a portion of the roll paper 12 on which a new image will be recorded to above the platen face PL of the platen 28. That is, in one conveying process, the conveying unit conveys the roll paper 12 a distance corresponding to the conveying direction length of the image frame F. During this conveying process, the controller 44 has the conveying unit convey the roll paper 12 in a normal conveying mode. In the normal conveying mode, the conveying unit continuously conveys the roll paper 12 at a first speed V1 (600 mm/sec in the first embodiment).

Thus, the controller 44 alternately executes a discharge process and a conveying process repeatedly when carrying out the recording operation.

Next, after having carried out the recording operation continuously for a predetermined time, the controller 44 interrupts the recording operation to switch to carrying out a cleaning operation for cleaning the recording part 36 (S504). Specifically, the controller 44 has the carriage 35*a* convey the recording head 36 as far as the cleaning part 66. When switching from the recording operation to the cleaning operation, the roll paper 12 is not fed, and the portion of the roll paper 12 where an image was recorded remains above the platen face PL of the platen 28. Even after switching the operation, the controller 44 continues to promote drying of the ink adhering to the roll paper 12 by controlling the heat quantity of the heater unit 61 based on the temperature detected by the temperature detection sensor 62 so as to bring the platen 28 to a predetermined temperature (for example, 45° C.), and by performing driving control of the air-blowing fan motor 64 so as to bring the blow volume of the air-blowing fan 63 to a predetermined blow volume.

Next, the controller 44 has the cleaning part 66 carry out a cleaning operation for cleaning the recording part 36 (S506). During the course of the cleaning operation, the controller 44 has the cleaning part 66 carry out a cleaning operation such as wiping. One cleaning operation of the cleaning part 66 takes about three minutes when shorter, or ten minutes when longer. During a cleaning operation, the roll paper 12 is not fed, and the portion of the roll paper 12 where an image was recorded remains above the platen face PL of the platen 28. Even during the cleaning operation, the controller 44 continues to promote drying of the ink adhering to the roll paper 12 by controlling the heat quantity of the heater unit 61 based on the temperature detected by the temperature detection sensor 62 so as to bring the platen 28 to a predetermined temperature (for example, 45° C.).

Figure 6:
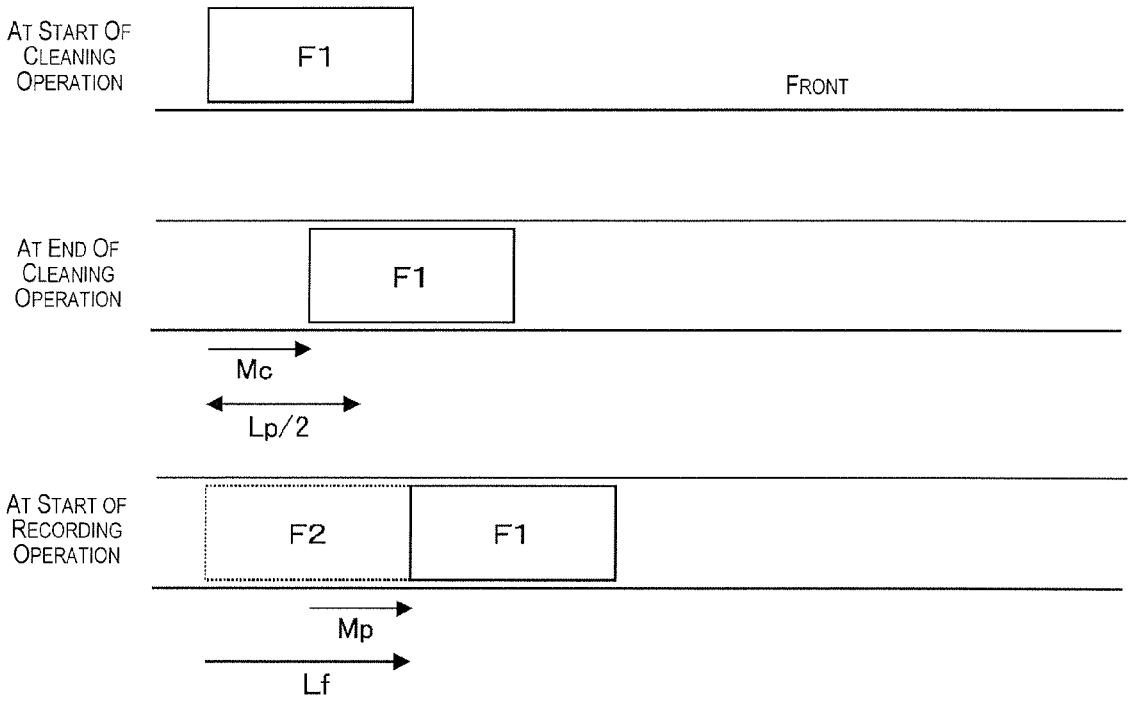
FIG. 6 is a diagram showing the positional relationship of an image frame F recorded on a roll paper 12 at the start and at the end of a cleaning operation, and at the start of a recording operation.

FIG. 6 is a diagram showing the positional relationship of the image frame F recorded on the roll paper 12 at the start and at the end of a cleaning operation, and at the start of a recording operation. As shown in FIG. 6, during the course of a cleaning operation, the conveying unit conveys the roll paper 12 a distance Mc (moves an image frame F1 a distance Mc) in a low-speed mode. In the low-speed mode, the average conveying speed is slower than in the normal conveying mode, and in the first embodiment, the roll paper is conveyed intermittently at a speed of 7.5 mm every 15 seconds. As a result, when one cleaning operation takes three minutes, for example, the distance that the roll paper 12 is conveyed during this time is 90 mm, which is shorter than the minimum conveying direction length of the image frame F of Lp/2 (457.2 mm). When one cleaning operation takes ten minutes, for example, the distance that the roll paper 12 is conveyed during this time is 300 mm, which is still shorter than the minimum conveying direction length of the image frame F of Lp/2 (457.2 mm).

When the cleaning operation is finished, the controller 44 switches from the cleaning operation to the recording operation (S508). Specifically, the controller 44 has the carriage 35*a* convey the recording head 36 from the cleaning part 66 to above the platen 28. Even after ending the cleaning operation, the controller 44 continues to promote drying the ink adhering to the roll paper 12 by controlling the heat quantity of the heater unit 61 based on the temperature detected by the temperature detection sensor 62 so as to bring the platen 28 to a predetermined temperature (for example, 45° C.), and by performing driving control of the air-blowing fan motor 64 so as to bring the blow volume of the air-blowing fan 63 to a predetermined blow volume.

The controller 44 causes the roll paper 12 to be conveyed in the normal conveying mode. As described earlier, the controller 44 conveyed the roll paper 12 in a low-speed mode while the cleaning part 66 carried out the cleaning operation. Although differing depending on the type of the cleaning operation, the conveying distance while carrying out the cleaning operation is a maximum of 300 mm (when the cleaning operation takes ten minutes), which is less than half the conveying direction length of the platen 28 (Lp/2); that is, less than the conveying direction length of the image frame F. As shown in FIG. 6, the conveying unit conveys the roll paper 12 a distance Mp (moves the image frame F1 a distance Mp) in the normal conveying mode before starting the next recording operation. The conveying unit controls this distance Mp to a distance of the conveying direction length Lf of the image frame F minus the distance Mc.

As shown in FIG. 6, the conveying unit conveys the roll paper 12 the distance Mc from the start to the end of a cleaning operation, and the conveying unit conveys the roll paper 12 the distance Mp from the end of the cleaning operation to the start of the recording operation. The conveying unit conveys the roll paper 12 a distance Lf (Lf=Mc+Mp) from the start of a cleaning operation to the start of the next recording operation, thus ensuring the area (the image frame F2) for the next recording operation.

When finished switching from a cleaning operation to the recording operation, the controller 44 carries out the recording operation again (S502).

Effectiveness of Printer

As described earlier, the (controller 44 of the) printer 11 according to the first embodiment can minimize wrinkling of a roll paper 12 by having the conveying unit for conveying the roll paper 12, the platen 28 for supporting the roll paper 12, the suction unit for suctioning the roll paper 12 to the platen 28, the recording head 36 for recording an image by discharging a liquid on the roll paper 12 being supported by the platen 28, the heater unit 61 for drying the liquid discharged on the roll paper 12 by heating the platen 28, the cleaning part 66 for cleaning the recording head 36, and the controller 44 for having the conveying part convey the roll paper 12 while the cleaning part 66 carries out a cleaning operation for cleaning the recording part 36.

Specifically, the heat of the heated platen 28 and the air blown by the air-blowing fan 63 promote drying of the ink adhering to the roll paper 12, and also promote drying of the portion of the roll paper 12 located above the platen 28. Because the roll paper 12 is conveyed successively during the recording operation, a specific portion of the roll paper 12 (the portion located above the platen 28; hereafter called "the portion above the platen") is not exposed to promotion of drying by the platen 28 and the air-blowing fan 63 for a long time, and drying of just a specific portion of the roll paper 12 (the portion above the platen) does not progress. From the start to the end of the cleaning operation, however, the roll paper 12 is stopped, and thus a specific portion of the roll paper 12 (the portion above the platen) remains above the platen 28 and is subject to promotion of drying by the platen 28 and the air-blowing fan 63, and drying of the specific portion of the roll paper 12 (the portion above the platen) progresses. When drying of a specific portion of the roll paper 12 (the portion above the platen) progresses and the portion of the roll paper 12 next to this portion (the portion of the roll paper 12 located near the upstream side (the left side) of the conveying direction as viewed from the platen 28 from the start to the end of the cleaning operation; hereafter called the "upstream portion") is not dried to a similar extent, nearby portions of the continuous roll paper 12 differ greatly in degree of drying, and are apt to wrinkle. In particular, a boundary where the degree of drying greatly differs occurs between the portion above the platen and the upstream portion of the roll paper 12, and the area near this boundary is apt to wrinkle.

According to the first embodiment, however, a specific portion of the roll paper 12 does not remain above the platen 28 during a cleaning operation because the conveying unit conveys the roll paper 12 while the cleaning part 66 is carrying out the cleaning operation. Therefore, it is only in specific portions of the roll paper 12 that drying does not progress, which can minimize wrinkling of the roll paper 12.

Because the conveying unit conveys the roll paper 12 while the cleaning part 66 is carrying out a cleaning operation, a boundary where the degree of drying greatly differs, such as described earlier, does not occur.

Figure 7:
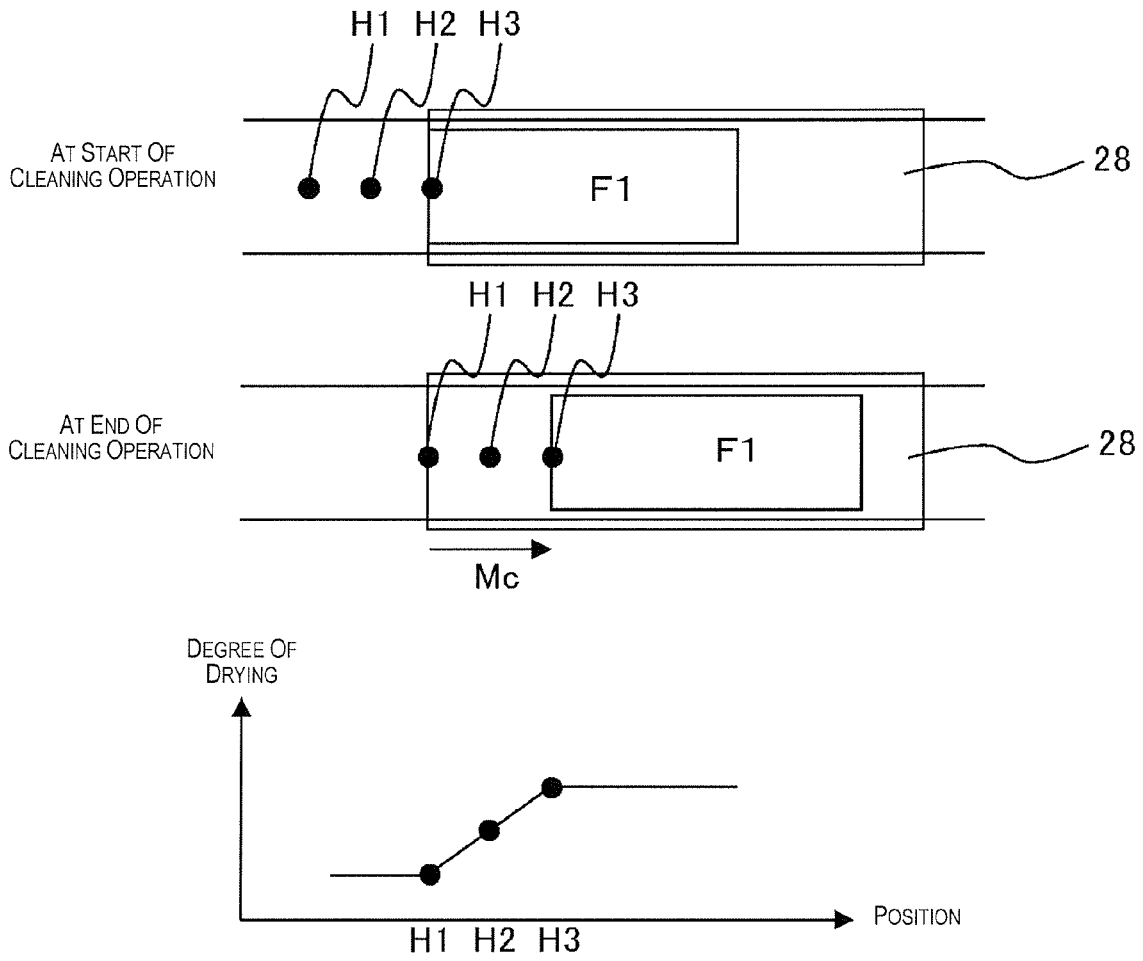
FIG. 7 is a conceptual diagram showing the degree to which a roll paper 12 is dried in different positions when a cleaning operation is started and ended.

FIG. 7 is a conceptual diagram showing the degree of drying at different locations on the roll paper 12 when starting and ending a cleaning operation. As shown in FIG. 7, when starting a cleaning operation, position H1 is located on the upstream side in the conveying direction of the platen 28 at the distance Mc from the edge of the upstream side, position H2 is located on the upstream side in the conveying direction of the platen 28 at the distance Mc/2 from the edge of the upstream side, and position H3 is located at the edge of the upstream side in the conveying direction of the platen 28. After the roll paper 12 with the positions H1, H2, H3 is conveyed the distance Mc from the start to the end of the cleaning operation, the position H1 is located at the edge of the upstream side in the conveying direction of the platen 28, and positions H2 and H3 are located on the platen 28. In FIG. 7, position H1 is a typical example of a slightly dried portion, position H2 is a typical example of a moderately dried portion, and position H3 is a typical example of an extensively dried portion.

While the cleaning part 66 is carrying out a cleaning operation, position H3 is located over the platen 28 and is dried by the platen 28 from the start to the end of the cleaning operation. Therefore, position H3 undergoes extensive drying (i.e., is a well-dried portion). Position H1, on the other hand, is located on the upstream side of the platen 28 in the conveying direction and is not dried by the platen 28 from the start to the end of the cleaning operation. Therefore, position H1 undergoes minimal drying (i.e., is a poorly dried portion). Position H2 is located on the upstream side of the platen 28 in the conveying direction and is not dried by the platen 28 from the start of the cleaning operation to midway in the cleaning operation, but is located above the platen 28 and is dried by the platen 28 from midway until the end of the cleaning operation, platen 28. Therefore, position H2 undergoes moderate drying (i.e., is a moderately dried portion).

The graph in FIG. 7 conceptually shows the degree of drying at different positions of the roll paper 12 (the degree of drying is shown linearly in the graph, but the linear representation is not given by way of limitation). As shown in FIG. 7, when the roll paper 12 located near the upstream edge in the conveying direction of the platen 28 is viewed from upstream to downstream in the conveying direction, the slightly dried portion appears first followed by the moderately dried portion, but within the moderately dried portion, the degree of drying gradually increases from the slightly dried portion, and is followed by the extensively dried portion. That is, having the conveying unit convey the roll paper 12 from the start to the end of the cleaning operation can erase boundaries where the degree of drying greatly differs. This can minimize wrinkling of the roll paper 12.

The printer 11 according to the first embodiment can eliminate wastage of the roll paper 12 even though the roll paper 12 is conveyed from the start to the end of the cleaning operation, because the conveying unit conveys the roll paper 12 in the conveying direction, and the controller 44 has the conveying unit convey the roll paper 12 a distance of no more than half of the conveying direction length of the platen 28 from the start to the end of the cleaning operation.

For comparison, when the conveying unit conveys the roll paper 12 a greater distance than the conveying direction length Lp of the platen 28 (for example, 914.4 mm) from the start to the end of the cleaning operation, a gap is produced between the image recorded before the cleaning operation and the image recorded after the cleaning operation. This is because the conveying direction length Lp of the platen 28 is greater than the conveying direction length Lf of the image frame F. As another comparison, even when the conveying unit conveys the roll paper 12 no more than a distance less than the conveying direction length Lp of the platen 28, but greater than half (Lp/2) the conveying direction length of the platen 28 from the start to the end of the cleaning operation, a gap may be produced, depending on the conveying direction length Lf of the image frame F, between the image recorded just before the cleaning operation and the image recorded just after the cleaning operation because, as described earlier, the conveying direction length Lf of the image frame F is greater than half (Lp/2) the conveying direction length of the platen 28 and no greater than the conveying direction length Lp of the platen 28. This is because the distance that the conveying unit conveys the roll paper 12 from the start to the end of the cleaning operation may be greater than the conveying direction length Lf of the image frame F.

However, when the conveying unit conveys the roll paper 12 as much as half (Lp/2) the conveying direction length from the start to the end of the cleaning operation, the location of the roll paper 12 can be adjusted, even after the operation has ended, by conveying the roll paper 12 just before the recording operation. This is because the distance that the conveying unit conveys the roll paper 12 from the start to the end of the cleaning operation is always less than the conveying direction length Lf of the image frame F, thus leaving room for adjustment. In other words, the upstream (left-side) edge in the conveying direction of the image recorded just before the cleaning operation is still located on the downstream (right-side) half above the platen 28 even after the roll paper 12 is conveyed from the start to the end of the cleaning operation. Conveying the roll paper 12 a suitable distance from this location allows the next image (after the cleaning operation) to be recorded in turn without a gap being left on the upstream (left-side) edge in the conveying direction of the image recorded just before the cleaning operation. Therefore, images can be recorded without wasting the roll paper 12.

The printer 11 according to the first embodiment can eliminate wastage of the roll paper 12 even though the roll paper 12 is conveyed from the start to the end of the cleaning operation, because the controller 44 selects any from among a plurality of types of cleaning operations differing in required operation time and causes it to be carried out by the cleaning part 66, and also has the conveying unit convey the roll paper 12 by a distance of half or less of the conveying direction length of the platen 28 from the start to the end of the cleaning operation regardless of which of any of the cleaning operations of the plurality of cleaning operations is the selected cleaning operation.

Specifically, although there are many types of cleaning operations requiring different operating times, even at the longest operating time, the conveying unit conveys the roll paper 12 as much as a distance of half or less of the conveying direction length of the platen 28 from the start to the end of the cleaning operation. Therefore, images can be recorded without a gap being left between the images recorded just before and just after the cleaning operation; that is, without wasting the roll paper 12.

The printer 11 according to the first embodiment can assuredly eliminate wastage of the roll paper 12 even though the roll paper 12 is conveyed from the start to the end of the cleaning operation, because the controller 44 has the conveying part convey the roll paper 12 from the end of the cleaning operation until the start of a recording operation for recording an image by the recording head 36 discharging a liquid on the roll paper 12, and determines the distance to have the conveying unit convey the roll paper 12 from the end of the cleaning operation to the start of the recording operation based on the length of the roll paper 12 conveyed by the conveying unit from the start to the end of the cleaning operation.

For comparison, when the roll paper 12 is conveyed no more than the conveying direction length Lf of the image frame F from the end of the cleaning operation to the start of the recording operation, the roll paper 12 is conveyed the distance Mc from the start to the end of the cleaning operation, then the roll paper 12 is conveyed the length Lf from the end of the cleaning operation to the start of the recording operation. Therefore, the roll paper 12 is conveyed a total distance of Mc+Lf from the start of the cleaning operation to the start of the recording operation. This results in the problem that a gap (an unrecorded portion) is produced in the roll paper 12 between the image recorded before the cleaning operation and the image recorded after the cleaning operation, wasting the roll paper 12. The controller 44, however, has the conveying unit convey the roll paper 12 based on the distance conveyed from the start to the end of the cleaning operation when switching from the cleaning operation to the recording operation. In the first embodiment, the conveying unit is controlled so that the distance Mc of the roll paper 12 conveyed by the conveying unit from the start to the end of the cleaning operation is subtracted from the conveying direction length Lf of the image frame F to find the distance Mp to have the conveying unit convey the roll paper 12 from the end of the cleaning operation to the start of the recording operation. As a result, images can be recorded without opening a gap between the images recorded just before and just after the cleaning operation; that is, without wasting the roll paper 12.

Other Embodiments

The first embodiment mainly describes a recording device, but also includes disclosure of, for example, a method for controlling a recording device. The first embodiment was devised to facilitate understanding of the present invention, and is not to be interpreted as limiting the present invention. Various variations and modifications may be possible without departing from the scope of the present invention, and the present invention includes equivalent configurations, as shall be apparent. In particular, the present invention includes the following embodiments.

In the first embodiment, an inkjet printer was described as an example of a liquid discharging apparatus, but the present invention is not limited to such as apparatus. For example, the present invention may be a liquid discharging apparatus for discharging a liquid other than ink. The present invention may be adapted to various types of liquid discharging apparatuses having a liquid jet head or the like for discharging very small droplets. "Droplets" refers to liquids discharged by the liquid discharging apparatus, and include droplets leaving granular, tear-like, or filamentous traces. The "liquid" may be any material that can be discharged by a liquid discharging apparatus. For example, the liquid may be in the state of a substance that is in a liquid phase, a liquid of high or low viscosity, a sol, or a gel, or indeed an organic solvent, an inorganic solvent, a solution, a liquid resin, or a liquid metal (metallic melt) or another liquid in a fluid state or one state of a substance. "Liquid" may also include those in which particles of a functional material comprising a solid, such as a pigment or metallic particles, have been dissolved in, dispersed with, or mixed together with a solvent. Examples of typical liquids are ink, such as described in the embodiments, liquid crystals, and the like. "Ink" here includes general-purpose water-based inks and oil-based inks, and a variety of liquid composites such as gel inks, hot melt inks, and the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a conveying part configured and arranged to convey a roll paper;

a support part configured and arranged to support the roll paper;

a recording part configured and arranged to eject liquid on the roll paper to record an image on the roll paper supported by the support part;

a heating part configured and arranged to heat the support part to dry the liquid ejected onto the roll paper;

a cleaning part configured and arranged to clean the recording part during the time when the conveying part conveys the roll paper on which the image has been recorded; and a controller configured to control the conveying part to convey the roll paper on which the image has been recorded while controlling the cleaning part to carry out a cleaning operation for cleaning the recording part.

2. The recording device according to claim 1, wherein the conveying part is configured to convey the roll paper in a conveying direction, and the controller is configured to control the conveying part to convey the roll paper a distance no more than half of a length of the support part in the conveying direction from start to end of the cleaning operation.

3. The recording device according to claim 2, wherein the controller is configured to select one of a plurality of types of cleaning operations differing in required operation time, and to control the cleaning part to carry out the one of the cleaning operations selected, and the controller is further configured to control the conveying part to convey the roll paper no more than half of the length of the support part in the conveying direction from the start to the end of the cleaning operation regardless of a type of the cleaning operation selected.

4. The recording device according to claim 3, wherein the controller is configured to control the conveying part to convey the roll paper from the end of the cleaning operation to start of a recording operation wherein the recording part ejects the liquid on the roll paper to record the image, and to determine the distance over which the roll paper is conveyed by the conveying part from the end of the cleaning operation to the start of the recording operation based on a length of the roll paper conveyed by the conveying part from the start to the end of the cleaning operation.

5. The recording device according to claim 1, wherein the support part is disposed in a recording region in which the recording part ejects the liquid on the roll paper to record the image, and the cleaning part is disposed outside of the recording region, and configured and arranged to clean the recording part after the recording part is moved to the cleaning part.

6. A method for controlling a recording device comprising:

controlling a cleaning part to perform cleaning of a recording part for ejecting a liquid on a roll paper supported by a heated support part to record an image on the roll paper; and controlling the conveying part to convey the roll paper supported by the support part, the controlling the cleaning part to perform the cleaning the recording part being during the time when the conveying part conveys the roll paper on which the image has been recorded.

* * * * *